US011913731B2

(12) United States Patent
Ballew et al.

(10) Patent No.: US 11,913,731 B2
(45) Date of Patent: Feb. 27, 2024

(54) PROCESS COOLING ROD

(71) Applicant: SaniSure, Inc., Camarillo, CA (US)

(72) Inventors: Chris Ballew, Thousand Oaks, CA (US); Richard Shor, Moorpark, CA (US); Matthew Markey, Newbury Park, CA (US); Joshua Rosen, Camarillo, CA (US)

(73) Assignee: SaniSure, Inc., Camarillo, CA (US)

( * ) Notice: Subject to any disclaimer, the term of this patent is extended or adjusted under 35 U.S.C. 154(b) by 0 days.

(21) Appl. No.: 18/344,641

(22) Filed: Jun. 29, 2023

(65) Prior Publication Data

US 2023/0392879 A1 Dec. 7, 2023

Related U.S. Application Data

(63) Continuation-in-part of application No. PCT/US2022/011634, filed on Jan. 7, 2022, which is (Continued)

(51) Int. Cl.

| | |
|---|---|
| ***F28F 1/40*** | (2006.01) |
| ***B21C 37/20*** | (2006.01) |
| ***F28F 13/12*** | (2006.01) |

(52) U.S. Cl.

CPC ..... *F28F 1/40* (2013.01); *B21C 37/207* (2013.01); *F28F 13/12* (2013.01)

(58) Field of Classification Search

CPC ..... F28F 1/40; F28F 13/12; F28F 5/04; B21C 37/207; F28D 7/12; F28D 7/106

See application file for complete search history.

(56) References Cited

U.S. PATENT DOCUMENTS 835,078 A * 11/1906 Nathan ..... B65D 85/84 165/142
1,813,057 A * 7/1931 Key ..... F28D 7/12 165/142

(Continued)

FOREIGN PATENT DOCUMENTS

EP 2853584 A1 9/2013
GB 2133524 A * 7/1984 ..... B29C 66/53465

(Continued)

OTHER PUBLICATIONS

World Intellectual Property Organization, International Search Report and Written Opinion for International Application No. PCT/US2022/011634, dated Apr. 7, 2022, 11 total pages.

*Primary Examiner* — Tho V Duong
(74) *Attorney, Agent, or Firm* — SoCal IP Law Group LLP; Guy Cumberbatch; Steven C. Sereboff

(57) ABSTRACT

A process heat exchange rod for cooling or heating liquids in a process vessel. The rod may have a linear form and extend downward through an upper wall of the process vessel into proximity with the lower floor. The rod internally defines a circulatory flow path for the heat exchange medium, including an outer jacket and a flow diverter having a central through bore and external helical flutes. Heat exchange medium travels down through the central through bore and then back up through helical grooves formed between the flow diverter and the outer jacket, or vice versa. Accurate heating or cooling of the process fluid is attained by modification of the configuration of the heat exchange rod as well as the flow rate and temperature of the heat exchange medium. The components may be injection molded of a polymer, often transparent, having a high heat transfer coefficient.

21 Claims, 12 Drawing Sheets

Related U.S. Application Data a continuation-in-part of application No. 17/467,397, filed on Sep. 6, 2021, now abandoned, which is a continuation of application No. 17/144,424, filed on Jan. 8, 2021, now Pat. No. 11,112,188.

(56) References Cited

U.S. PATENT DOCUMENTS

| | | | | |
|---|---|---|---|---|
| 3,952,724 | A * | 4/1976 | Pei | F24S 10/45 165/142 |
| 4,162,855 | A * | 7/1979 | Bender | A47J 43/0465 366/274 |
| 4,452,233 | A * | 6/1984 | Goodman, Jr. | F24S 80/30 165/184 |
| 4,548,257 | A * | 10/1985 | Williamson | F28B 9/10 165/142 |
| 5,339,890 | A | 8/1994 | Rawlings | |
| 5,667,758 | A | 9/1997 | Matsugi et al. | |
| 5,765,385 | A | 6/1998 | Childs | |
| 6,467,506 | B1 * | 10/2002 | Nguyen | F16L 31/00 123/41.1 |
| 6,952,934 | B2 | 10/2005 | Lee | |
| 2005/0139344 | A1 * | 6/2005 | Butler | F28D 20/0034 165/142 |
| 2013/0312946 | A1 * | 11/2013 | Chan | F28D 7/1607 165/96 |
| 2014/0363146 | A1 | 12/2014 | Compton | |
| 2015/0075759 | A1 | 3/2015 | McCandlish et al. | |
| 2016/0348088 | A1 * | 12/2016 | Chevrot | C07K 7/62 |

FOREIGN PATENT DOCUMENTS

| | | | |
|---|---|---|---|
| GB | 2133524 | A | 7/1984 |
| JP | 63163792 | A | 1/1988 |
| JP | 03007891 | A | 1/1991 |

* cited by examiner

FIG. 13A
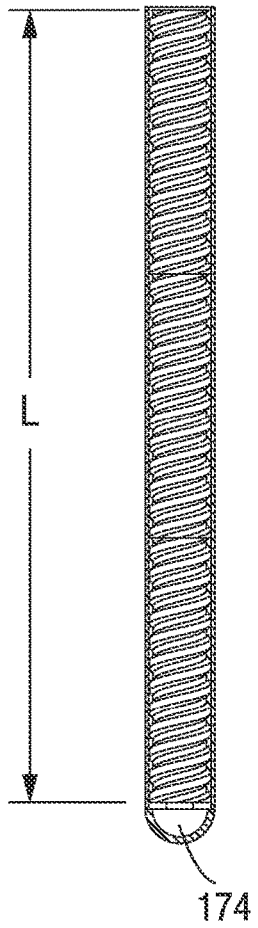
FIG. 13B
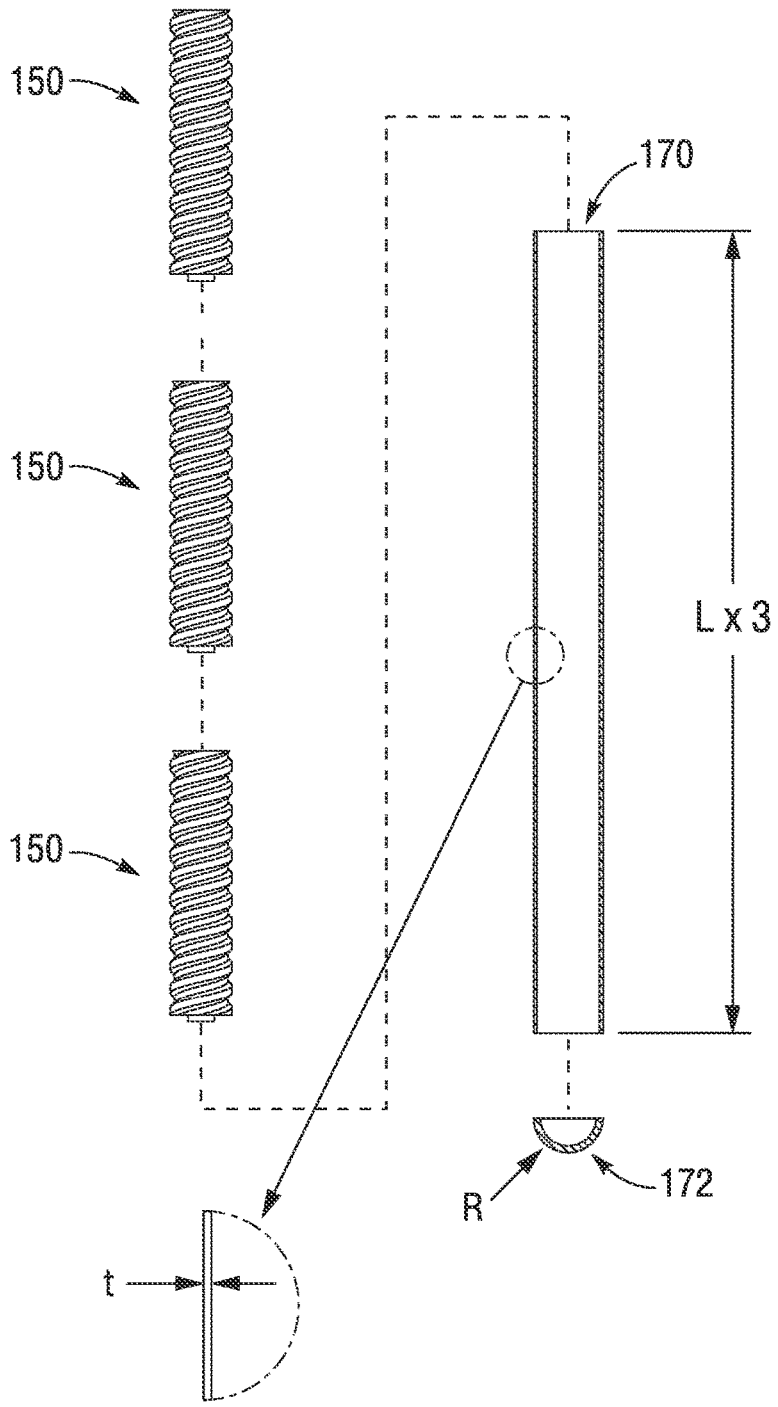
FIG. 13C

PROCESS COOLING ROD

RELATED APPLICATION INFORMATION

This application is a continuation-in-part of International Patent Application No. PCT/US22/11634, filed Jan. 7, 2022, which is a continuation-in-part of U.S. patent application Ser. No. 17/467,397, filed Sep. 6, 2021, which is a continuation of U.S. patent application Ser. No. 17/144,424, filed Jan. 8, 2021, now U.S. Pat. No. 11,112,188, the contents of which are hereby incorporated by reference in their entireties.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a heat exchange element for chemical and biological processes.

Description of the Related Art

Various chemical and biological processes in lab settings generate heat. For example, constant filtration of a process medium can quickly raise the temperature of the medium leading to deleterious outcomes, especially for fragile biological cells grown in media. A standard technique for reducing the temperature of process contents is to place the reactor or container within an ice bath. However, this introduces a number of challenges, not the least of which is accurately and consistently regulating the amount of cooling. Processes also sometimes require the addition of heat in regulated amounts.

There remains a need for a rapid heat exchange solution for chemical and biological processes that accurately and consistently regulates the amount of cooling or heating.

SUMMARY OF THE INVENTION

The present application discloses a process cooling element in the shape of a rod is described which can be inserted into a bioreactor or other reactor vessel to regulate the temperature. A method of use of the process cooling element includes immersing the rod into a liquid within a process vessel, the rod extending to at least 1 inch of the floor of the vessel to enable heat transfer with even small amount of liquid in the vessel. A manifold that projects out of the vessel has a fluid inlet connector and a fluid outlet connector. The cooling element includes an outer jacket and an inner flow diverter that extends from the manifold to a closed distal end of the outer jacket. The flow diverter has a central through bore and one or more outer helical flutes that contact an inner wall of the jacket and define one or more helical flow passages the length of the flow diverter. The method includes flowing cooling fluid into the inlet connector which travels down through the central bore and then up through the helical flow passage(s) to the outlet connector. The flow may be reversed so that the inlet becomes the outlet. The outer jacket and flow diverter are desirably formed of a polymer, sometimes transparent, with a high coefficient of heat transfer; which may be greater than 0.50 W/mK @23 C or even greater than 0.90 W/mK @23 C. Alternatively, only the flow diverter is polymer while the outer jacket is a non-reactive metal such as Stainless Steel, Titanium or similar expedients.

A first embodiment of a device disclosed herein comprises a fluid process heat exchange rod for heating or cooling fluid in a process vessel. The first embodiment has an elongated outer jacket extending along an axis defining a closed distal end and an open proximal end, an inner cavity defined within the outer jacket. A manifold attaches to the proximal end of the outer jacket and has two connectors providing fluid communication with the inner cavity; a first connector being offset from a centerline through the manifold and a second connector being located along the centerline and aligned with the outer jacket axis. An elongated polymer flow diverter is positioned within the inner cavity. The flow diverter extends from the manifold to a point spaced from the closed distal end such that a distal space is formed in the inner cavity between the flow diverter and the closed distal end. The flow diverter has a central inner bore extending the length of the flow diverter and being in fluid communication with the second connector to fluidly connect the second connector and the distal space. The flow diverter also has an outer surface defined by at least one helical flute extending the length of the flow diverter and having an outer diameter approximately equal to an inner diameter of the outer jacket so as to be in contact therewith. The at least one helical flute defines at least one helical groove spaced inward from the inner diameter of the outer jacket that forms at least one helical flow passage between the flow diverter and the outer jacket fluidly connecting the first connector and the distal space. The heat exchange rod is configured such that fluid flowing into the second connector passes distally through the inner bore to the distal space, and returns proximally from the distal space through the at least one helical flow passage to the first connector, and fluid flowing into the first connector passes distally through the at least one helical flow passage to the distal space, and returns proximally from the distal space through the inner bore to the second connector. The fluid flowing through the heat exchange rod is therefore adapted to heat or cool fluid within the process vessel. Further, there may be two parallel helical flutes formed in the flow diverter that define two parallel helical grooves. The elongated jacket may be linear and tubular and the closed distal end hemispherical.

A second embodiment of a device disclosed herein comprises essentially the same fluid process heat exchange rod for heating or cooling fluid in a process vessel described above. However, instead of having flow diverter with an outer surface defined by at least one helical flute, the flow diverter outer surface is defined by ribs extending the length of the flow diverter having an outer diameter approximately equal to an inner diameter of the outer jacket so as to be in contact therewith. The ribs define at least one flow passage between the flow diverter and the outer jacket fluidly connecting the first connector and the distal space, and heat exchange fluid flows through the at least one flow passage.

In any embodiment described herein, the flow diverter may be injection molded of a polymer having a heat transfer coefficient of at least 0.50 W/mK @23 C, or at least 0.90

W/mK @23 C. The polymer may be transparent, and may be polycarbonate or a polypropylene base resin.

In any embodiment described herein, the device may further include a process vessel adapted for holding fluid, the process vessel having an upper wall, wherein the heat exchange rod is mounted to the upper wall of the process vessel such that the closed distal end of the outer jacket extends downward toward a bottom of a main portion of the process vessel so as to be submerged in fluid within the process vessel. The process vessel may be a flask having a large main portion and an upwardly angled shoulder region that forms the upper wall, and the heat exchange rod mounts through a hole formed in the upper wall such that the closed distal end of the outer jacket extends downward toward a bottom of the main portion of the process vessel.

DESCRIPTION OF THE DRAWINGS

FIGS. 13A and 13B are assembled and exploded elevational views of an exemplary process cooling rod formed with three of the modular flow diverter sections as seen in FIG. 12A, and FIG. 13C is a cross-section through a sidewall of an outer housing of the cooling rod.

DETAILED DESCRIPTION

A process cooling element in the shape of a rod is described which can be inserted into a bioreactor or other reactor vessel to regulate the temperature. The primary application of the cooling rod is to reduce the temperature of the medium, but it should be understood that the beneficial attributes of the cooling rod also apply to raising the temperature of a process medium, and thus, more broadly, a heat exchanging element or rod is disclosed. Additionally, the cooling element is preferably shaped as an elongated linear rod, but could be adapted into other shapes, such as a curved rod or an irregular shape that mirrors the shape of the vessel in which it is used. Moreover, the size of the process cooling rod may vary depending on the cooling capacity required, and though a single cooling rod is shown in the exemplary application, multiple cooling rods can be used. Finally, preferred materials for the cooling rod are described, but should not be considered limiting unless explicitly claimed.

One particularly useful application for the process heat exchange element is to heat and thus thin out liquids such as manufactured drugs during a filling step. That is, the heat exchange element may be placed in close proximity to a filling needle descending into a process vessel containing liquid drugs. The efficient heating of the liquid immediately surrounding the fill needle thins the liquid and thus facilitates withdrawal from the vessel. Another application is during ultra-filtration of various media. Certain filters used in bioreactors tend to build up retentate and heat up from the added resistance to fluid flow therethrough. The heating may damage the valuable media, and placing the heat exchange element in the fluid.

Figure 1:
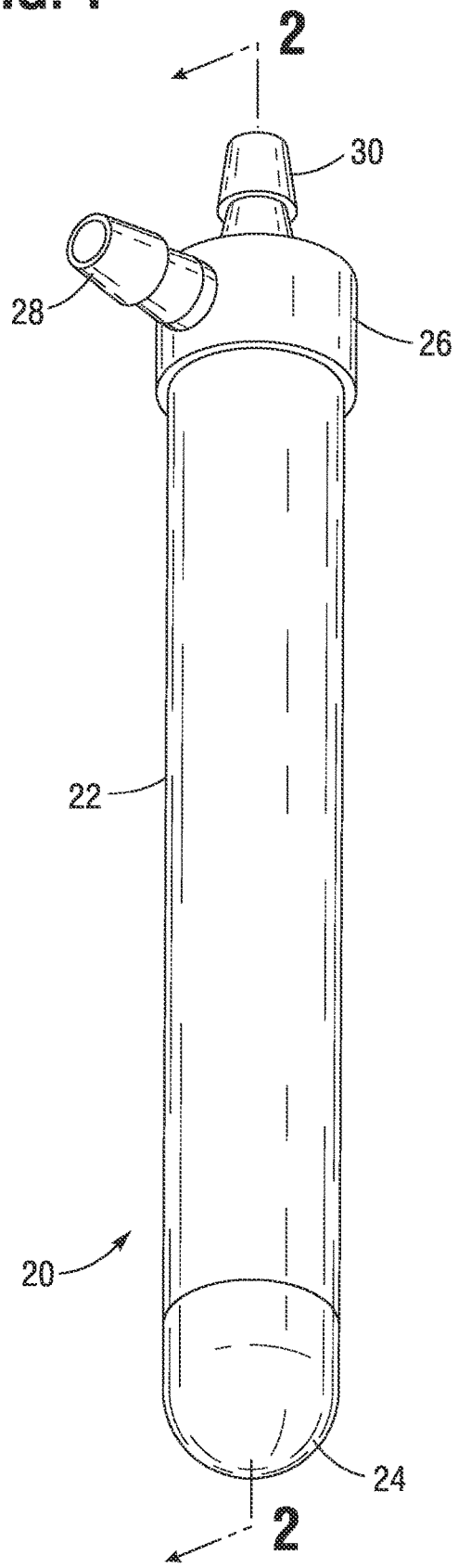
FIG. 1 is a perspective view of an exemplary process cooling rod.
Figure 2:
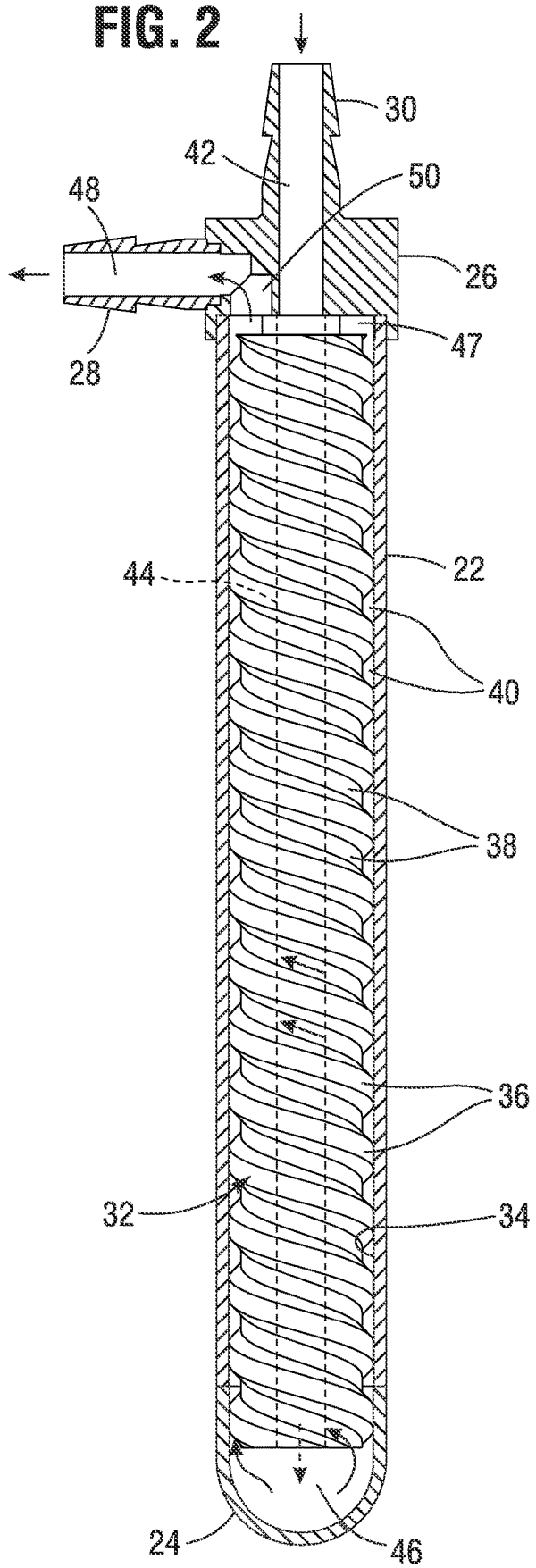
FIG. 2 shows the process cooling rod in longitudinal section.

FIG. 1 is a perspective view of an exemplary process cooling rod 20, and FIG. 2 shows the exemplary process cooling rod in longitudinal section. In the exemplary embodiment, the cooling rod 20 includes a hollow outer housing or jacket 22 having a closed end 24 and a hub or manifold 26 secured to an open end of the housing opposite the closed end. The manifold 26 provides a mount and internal passages for a first connector 28 and a second connector 30. The outer jacket 22 may be tubular and linear, defining a longitudinal axis, with the closed end 24 being formed by a hemispherical cap. The manifold 26 has a generally cylindrical configuration and is sealingly attached around the outside of the open end of the jacket 22, as seen in section in FIG. 2. Adhesives or heat bonding may be used to connect the parts. The first connector 28 projects radially from the manifold 26, while the second connector 30 projects axially and is centered along the longitudinal axis. Both connectors 28, 30 may be formed as conventional hose barbs.

Figure 3:
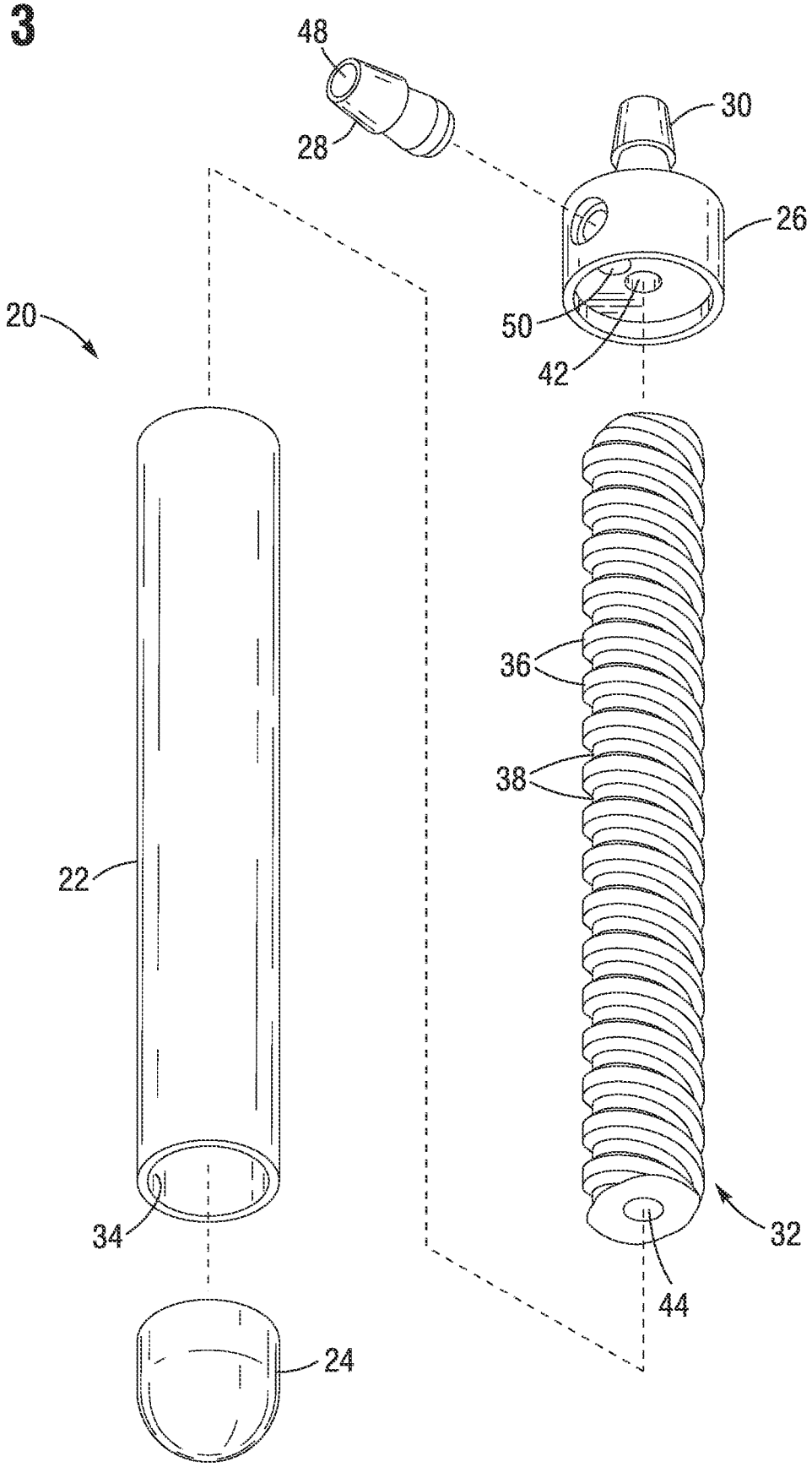
FIG. 3 is an exploded view of the process cooling rod.

With reference also to the exploded view of FIG. 3, an elongated flow diverter 32 fits closely within an inner wall 34 of the tubular jacket 22 and extends substantially its entire length. The flow diverter 32 defines helical ribs or flutes 36 which have flat outer lands sized approximately the same as the diameter of the inner wall 34 which helps provide a seal therebetween. The helical flutes 36 are sized and have a pitch such that there are two parallel flutes extending the length of the diverter 32. Recessed helical grooves 38 are formed between the flutes 36 which the define helical flow passages 40 within the inner wall 34.

The axially-oriented second connector 30 defines a central through bore 42 centered on the longitudinal axis which is in fluid communication with a central bore 44 through the flow diverter 32. The bore 44 extends the length of the flow diverter 32 between the manifold 26 and a plenum chamber 46 defined between a distal end of the diverter and the inside wall of the hemispherical cap 24. As seen by the arrows, pressurized fluid flowing into the through bore 42 of the connector 30 travels downward through the bore 44 until it reaches the plenum chamber 46.

The helical grooves 38 are open to the bottom end of the flow diverter 32 and thus the pressurized fluid within the plenum chamber 46 travels upward along the grooves. Eventually, fluid reaches the top of the flow diverter 32 and enters an annular space 47 defined within the outer jacket 22 and manifold 26. An outlet flow passage 48 formed within the first radially-oriented connector 28 communicates with the annular space 47 via a short axial passage 50 in the manifold 26. Of course, it should be understood that the flow can be reversed with the pressurized fluid entering through the first connector 28 and traveling downward through the helical grooves 38 and upward through the central bore 44. Either way, a constant flow of cooling (or heating) fluid can be circulated through the process cooling rod 20. Although not shown, the heat exchange medium may be circulated through a chiller or heater external to the heat exchange rod 20 and positioned near to the process vessel.

As seen in FIG. 3, the first connector 28 may be an item that is separately molded from the manifold 26. The second connector 30 may also be separate, but as seen in section in FIG. 2, is desirably molded as one piece with the manifold.

Figure 4:
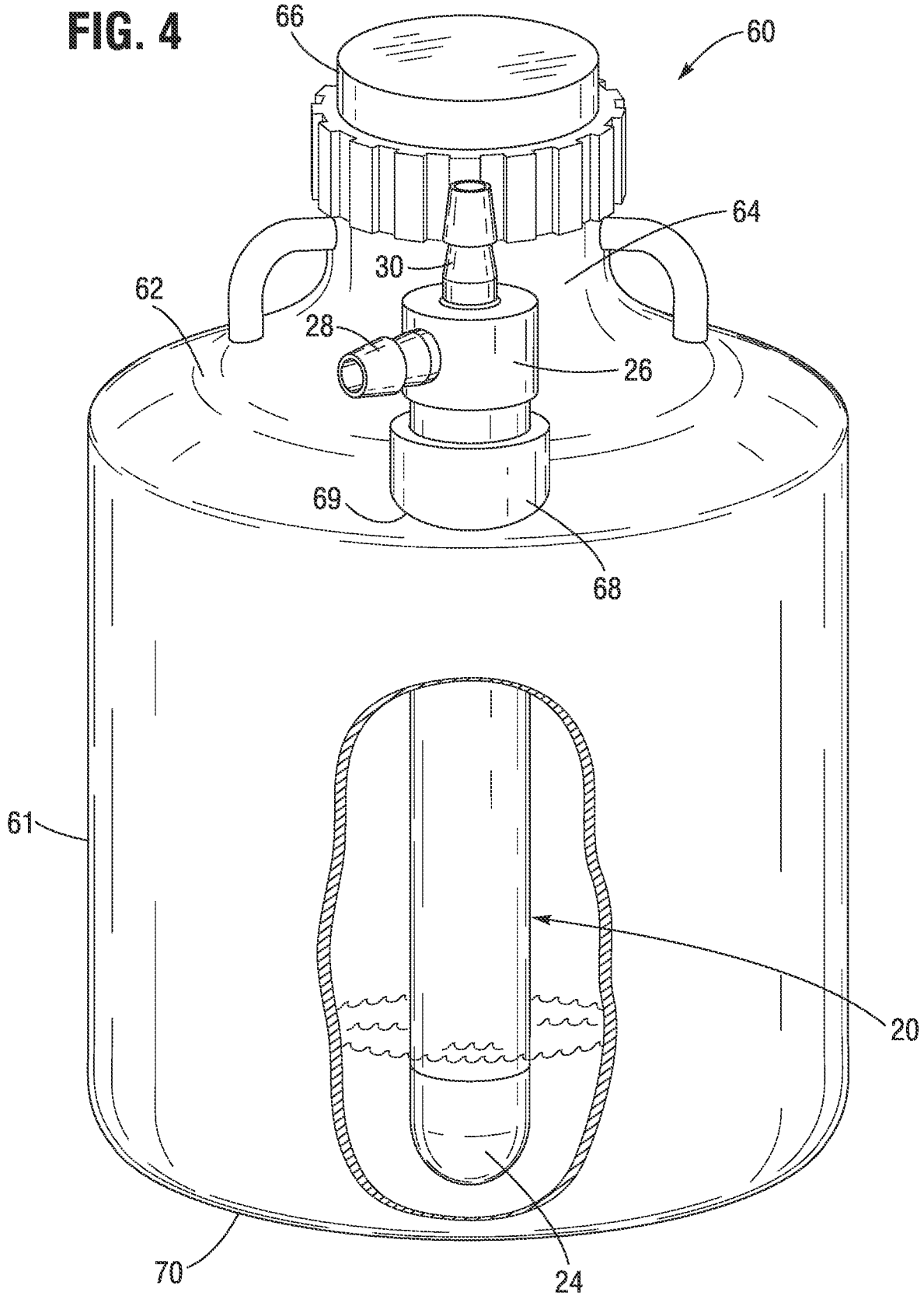
FIG. 4 shows a process vessel having the exemplary process cooling rod mounted through an upper wall thereof with a sealing sleeve.

FIG. 4 shows a process vessel 60 having the exemplary process cooling rod 20 mounted through an upper wall 62 thereof. In the illustrated embodiment, the process vessel 60 is a large flask having a generally cylindrical main portion 61 and an upwardly angled shoulder region that forms the upper wall 62. The vessel 60 continues upward into a neck region 64 leading to an upper mouth closed by a cap 66. The cap 66 may be replaced with a stirring assembly in some applications.

For sterility, a sleeve or other type of sealing sleeve 68 may be secured between the cooling rod 20 and a hole 69 through the upper wall 62. The sealing sleeve 68 may be removable, or the cooling rod 20 may be assembled (bonded or welded) with the process vessel 60 using the sealing sleeve 68, and sold as a single unit, thus providing a built-in option for cooling or heating the process fluid within the vessel. The sealing sleeve 68 may be elastomeric or a more rigid polymer bonded or welded to both the cooling rod 20 and the hole through the upper wall 62.

The cooling rod 20 extends downward into the process vessel 60 until the closed end cap 24 is in close proximity to a floor 70 of the vessel. In one embodiment, the length of the cooling rod 20 is such that when mounted through the sealing sleeve 68 the closed end cap 24 extends to within 1 inch of the floor 70 of the vessel 60. In this way, the cooling rod 20 reaches even low levels of fluid in the bottom of the vessel, as shown, to commence heat exchange therewith.

Although not shown, inlet and outlet tubular fluid conduits are then attached to the first and second connectors 28, 30 projecting from the manifold 26 to initiate cooling (or heating) flow through the cooling rod 20. As will be understood by those of skill in the art, the temperature and flow rate of the fluid through the cooling rod 20 can be varied so as to accurately regulate the temperature of the fluid within the vessel 60.

Figure 5:
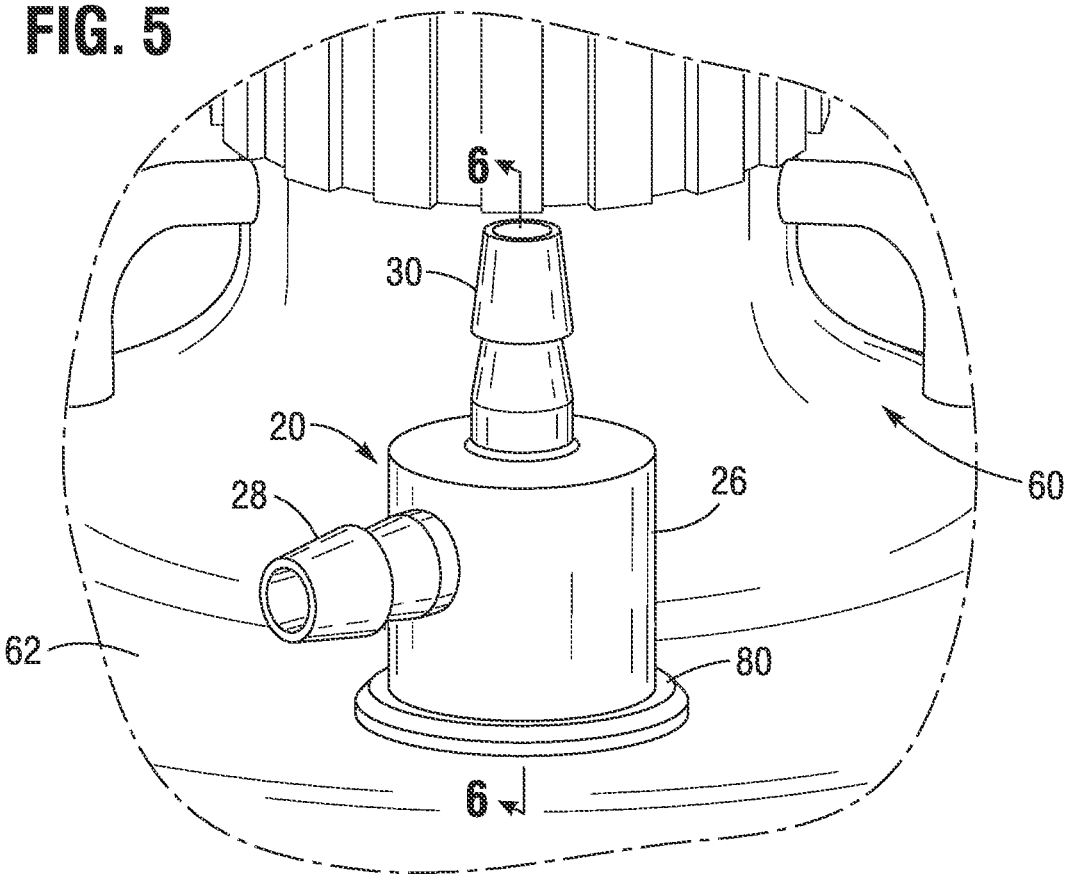
FIG. 5 is an enlargement of an upper wall of a process vessel showing an alternative mounting arrangement for the process cooling rod.
Figure 6:
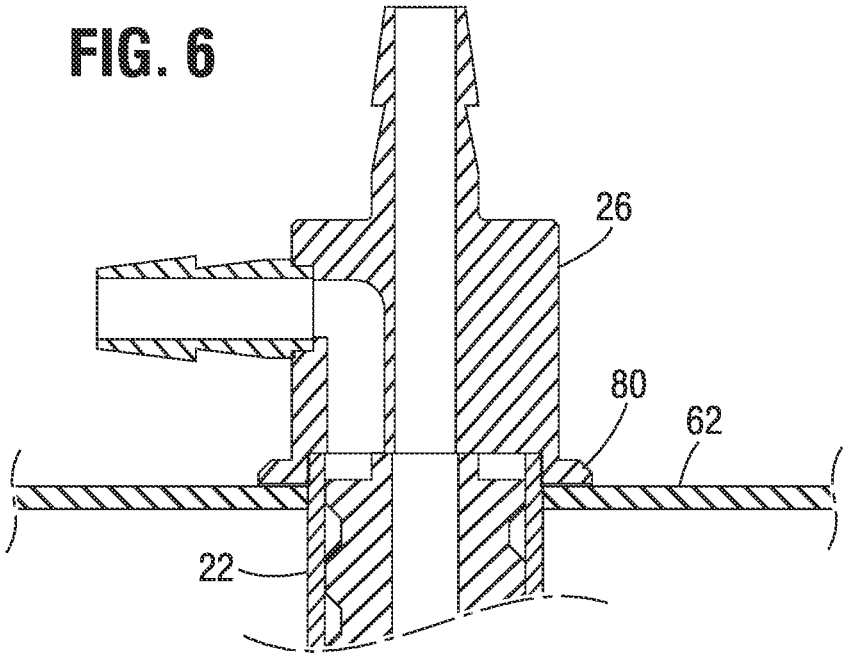
FIG. 6 is a vertical sectional view therethrough.

FIG. 5 is an enlargement of an upper wall 62 of a process vessel 60 showing an alternative mounting arrangement for the process cooling rod 20. FIG. 6 is a vertical sectional view of the alternative mounting arrangement, and shows the tubular jacket 22 of the cooling rod 20 passing downward through the hole in the upper wall 62. A circular flange 80 is formed at the lower end of the manifold 26 which is secured to the upper wall 62 via adhesive or bonding/welding. This mounting arrangement enables a more permanent connection which may be assembled by a manufacturer so that the process vessel 60 is shipped and sold as one with the cooling rod 20 installed.

Figure 7:
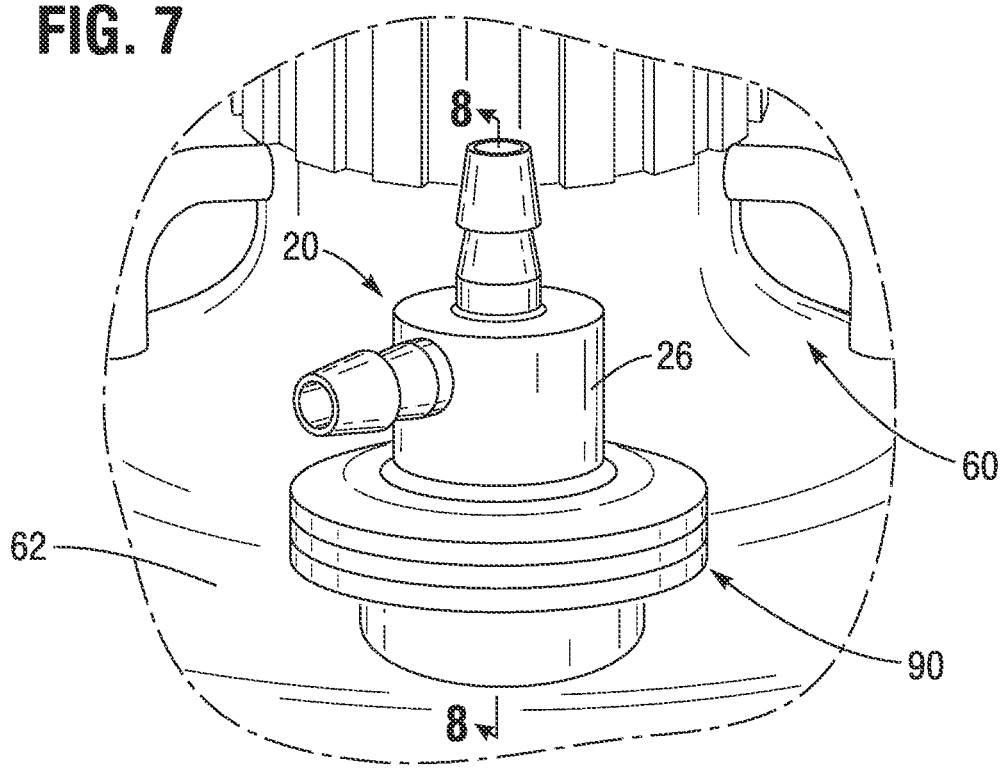
FIG. 7 is an enlargement of an upper wall of a process vessel showing a tri-clamp mounting assembly for the process cooling rod.
Figure 8:
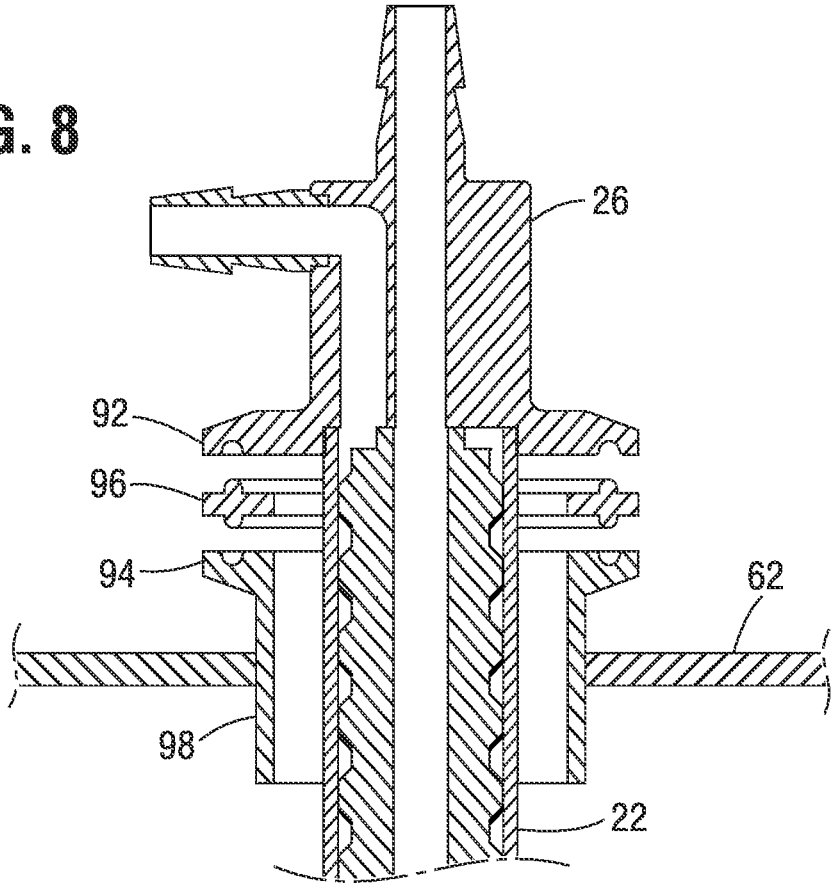
FIG. 8 is an exploded vertical sectional view therethrough.

FIG. 7 is an enlargement of an upper wall 62 of a process vessel 60 showing a tri-clamp mounting assembly 90 for the process cooling rod 20. FIG. 8 shows the assembly 90 exploded, which includes an upper flange 92 and a lower flange 94 that together sandwich an elastomeric gasket 94 therebetween. The upper flange 92 is shown formed as an integral part of the manifold 26 of the cooling rod 20, though of course it may be formed separately and sealed thereto. The lower flange 94 is connected to a downwardly-directed tubular sleeve 98. The tubular sleeve 98 passes downward through the hole in the upper wall 62 and may be sealed or otherwise bonded or fastened thereto. A lower surface of the upper flange 92 and an upper surface of the lower flange 94 have circular grooves that mate with circular ribs on top and bottom of the elastomeric gasket 94, as shown.

Although not shown, an external mechanical clamp is used per convention to hold the three tri-clamp parts together temporarily for a sanitary hermetic seal. For instance, Sanitary Fittings, LLC of Muskego, WI provides a number of different such clamps at https://sanitaryfittings.us/product-category/fittings/clamp-fittings/clamps, which are incorporated by reference.

The tri-clamp mounting assembly 90 enables easy attachment and detachment of the process cooling rod 20, or an alternative device such as a sampling instrument. Conversely, a cap may be attached to the lower flange 94 to close the opening.

Figure 9:
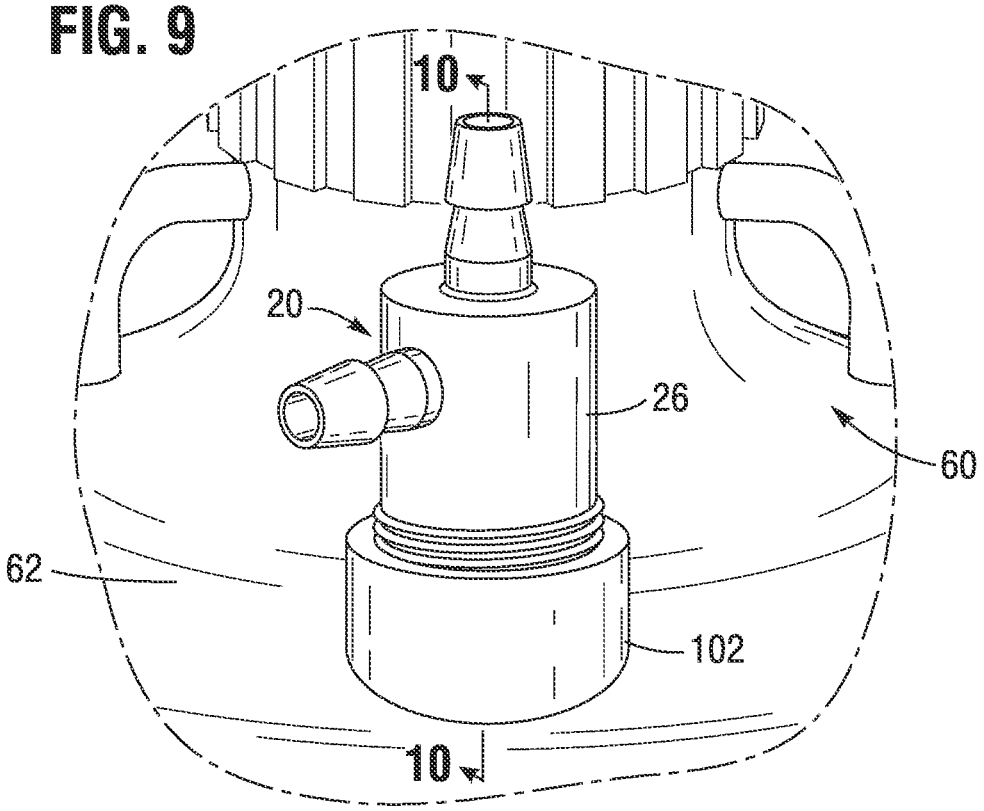
FIG. 9 is an enlargement of an upper wall of a process vessel showing a threaded mounting arrangement for the process cooling rod.
Figure 10:
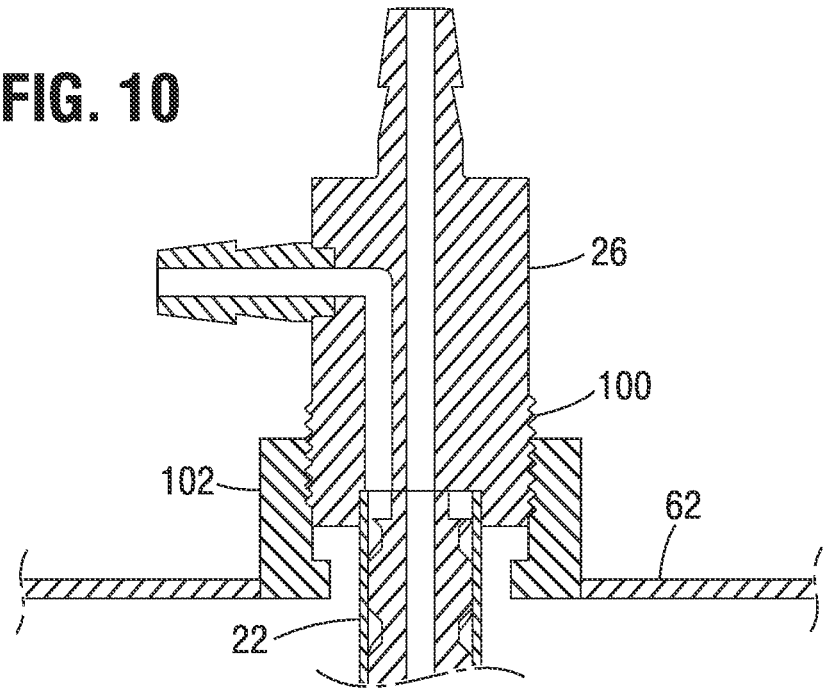
FIG. 10 is a vertical sectional view therethrough.

FIG. 9 is an enlargement of an upper wall 62 of a process vessel 60 showing a threaded mounting arrangement for the process cooling rod 20, and FIG. 10 is a vertical sectional view therethrough. In this assembly, male threads 100 formed at a lower end of the cooling rod manifold 26 mate with internal threads within a mounting sleeve 102. The sleeve 102, in turn, extends downward through the hole in the upper wall 62 and may be sealed or otherwise bonded or fastened thereto. The mating threads may be PG thread such as PG13.5 with a thread angle of 80°, commonly used for probes such as pH electrodes, Dissolved Oxygen (DO) probes, or temperature and conductivity probes, or they could be standard NPT thread, tapered or straight. This simple mounting architecture again enables easy attachment and detachment of the process cooling rod 20, or an alternative device such as a sampling instrument, or a plug may be attached to the mounting sleeve 102 to close the opening.

Figure 11:
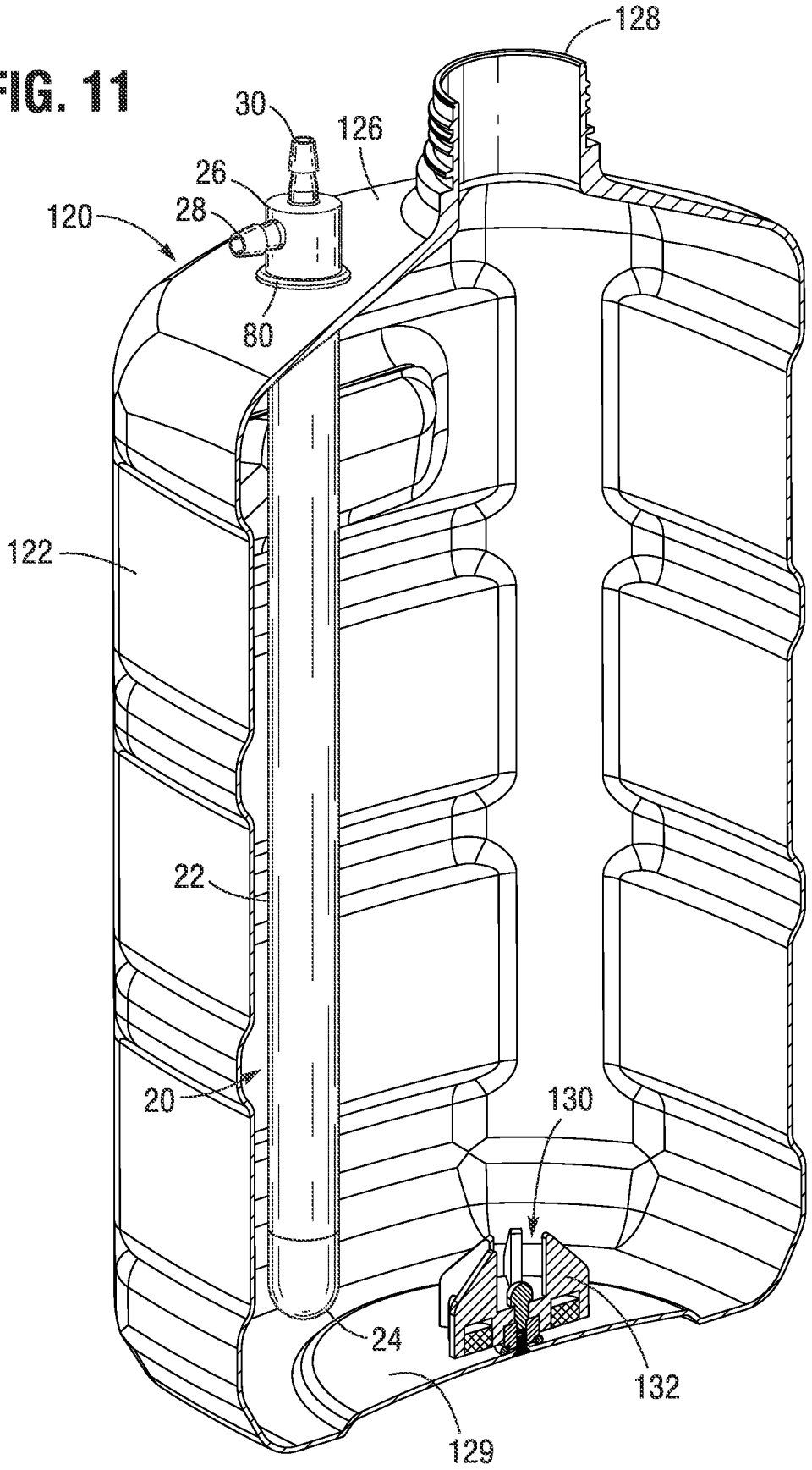
FIG. 11 is a cutaway view of an exemplary flask having an internal mixer with vanes journaled to rotate about a lower floor thereof and showing placement of the exemplary process cooling rod therein.

FIG. 11 is a cutaway perspective view of an exemplary flask or vessel 120 forming part of a process reactor and mixing system with which the process cooling rod 20 may be integrated. The vessel 120 includes a large main portion with vertical sidewalls 122 which may be reinforced with ribs or other stiffening features as shown, and may incorporate indents (not shown) on opposite sides that function as handles. An upwardly angled shoulder region or upper wall 126 leads to an upper opening 128, to which a cap (not shown) may be fastened for sealing the contents of the vessel. In some processes, the cap may include ports and tubes that extend downward for introducing or removing fluid from within the interior of the vessel 120, such as described in U.S. Pat. No. 10,260,036 to Shor, et al., the contents of which are hereby expressly incorporated by reference. The vessel 120 may be provided in volumes between 500 ml to 50 liters and made of PET or Polycarbonate.

FIG. 11 illustrates an internal mixer 130 with vanes 132 journaled to rotate about a vertical axis just above a lower floor 129 of the vessel. The mixer 130 is desirably rotated by an external magnetic drive (not shown and sometimes called a stir plate) below and outside of the vessel 120. For example, the mixer 130 may incorporate two diametrically opposed rare-earth or ceramic magnets that face the floor 129, and the magnetic drive has a rotating electromagnet or rotating rare-earth magnets (not shown) as well. Due to the close proximity to the mixer 130, the magnetic drive is able to rotate the mixer.

As described above, the cooling rod 20 extends downward into the process vessel 120 until the closed end cap 24 is in close proximity to the floor 129 of the vessel 120. In one embodiment, the length of the cooling rod 20 is such that when mounted through the top wall 126 the closed end cap 24 extends to within 1 inch of the floor 129 of the vessel 120. In this way, the cooling rod 20 reaches even very low levels of fluid in the bottom of the vessel to initiate heat exchange therewith. Moreover, the cooling rod 20 reaches the fluid surrounding the mixer 130 for effective simultaneous heat transfer and fluid agitation.

The helical structure of the flow diverter 32 maximizes the surface area of the outer helical cooling channel. Advantageously, the flow diverter 32 is made out of plastic. In one embodiment, all of the components may be made out of transparent Polycarbonate which will allow video or still images to be taken of the flow as it flows. Preferably, the material is a plastic which is a) non-reactive, and b) one with as high a thermal transfer coefficient as possible, c) easy to manufacture, and d) recyclable. Stainless Steel and other non-reactive metals would work, though they are not perceived as disposable. One useful combination is a flow diverter 32 made of plastic with a tubular jacket 22 made of Stainless Steel.

One exemplary material for the flow diverter 32 is a highly heat conductive plastic termed Therma-Tech available from PolyOne Corporation of Avon Lake, Ohio. The Therma-Tech polymer formulation is a polypropylene base resin. A specific formulation given the product name X TT-10279-002-04 EI Natural (EM1003511360) by PolyOne has the following physical properties:

| Property | Method | Value/units |
|---|---|---|
| Specific Gravity | ASTM D792 | 1.37 |
| Tensile Strength at Break | ASTM D638 | 3573 psi |
| Elongation at Break | ASTM D638 | 3.0% |
| Flexural Modulus | ASTM D790 | 354,000 psi |
| Flexural Strength at Yield | ASTM D790 | 6000 psi |
| Thermal Conductivity (TC)-In-plane | ASTM E1461 | 1.15 W/mK |
| Thermal Conductivity (TC)-Through-plane | ASTM E1461 | 0.98 W/mK |

Advantageously, the Therma-Tech polypropylene has a 40% higher thermal transfer rate than polycarbonate. Polycarbonates typically have a thermal transfer rate of between 0.19-W/mK @23 C. Preferably, therefore, the polymer used has a thermal transfer rate of at least W/mK @23 C, and more preferably at least 0.90 W/mK @23 C.

In a preferred embodiment, the flow diverter 32 having the helical ribs or flutes 36 is molded from a highly heat conductive plastic such as a polypropylene base resin like Therma-Tech. For reusable applications, the outer housing or jacket 22 and closed end 24 are formed of a highly heat conductive such as Stainless Steel, as mentioned above. The process cooling rod 20 is capable of heating or cooling process vessels in a much faster time than with prior methods, such as surrounding the vessel with a heating or cooling blanket or simply placing the vessel within a cooler.

The present application contemplates process cooling rods that are sized and operated for use in vessels with volumes between 500 ml to 50 liters, as stated. The cooling rods may be sized proportionally up and down, and the temperature, flow rate and composition of the heat transfer fluid may be adjusted accordingly. One highly efficient way to scale the cooling rod size is to use modular sections of the flow diverters, which are complex molded pieces.

Figure 12A:
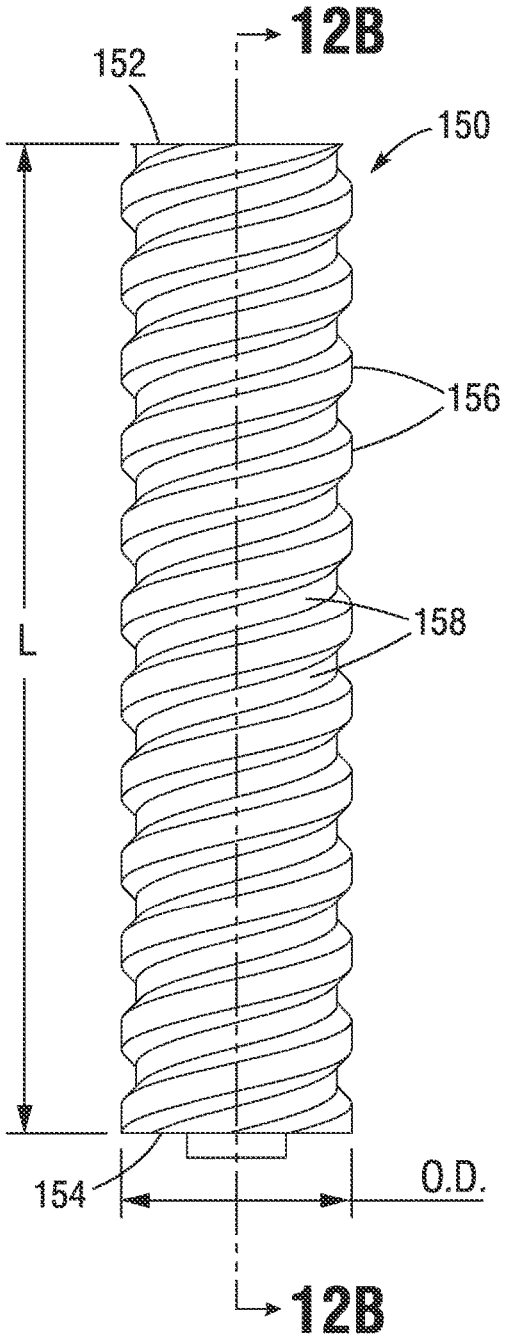
FIG. 12A is an elevational view of a modular section of a flow diverter for assembling various process cooling rods described herein.
Figure 12B:
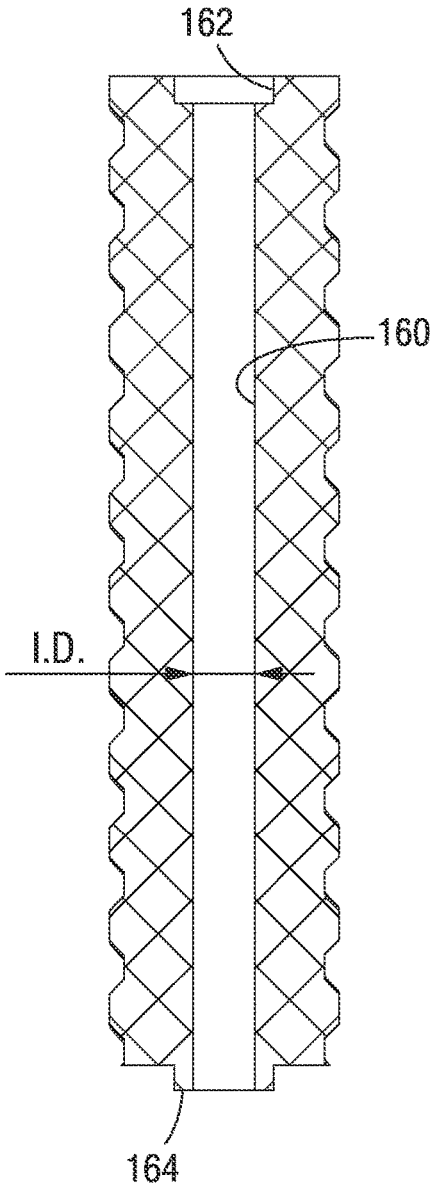
FIG. 12B is a longitudinal sectional view thereof.

For example, FIG. 12A shows a modular section 150 of a flow diverter for assembling various process cooling rods described herein, and FIG. 12B is a longitudinal sectional view thereof. The modular section 150 is generally elongated and tubular, extending a length L from a top end 152 to a bottom end 154. The flow diverter section 150 defines helical ribs or flutes 156 with helical grooves 158 therebetween. Flat outer lands of the flutes 156 together describe an outside diameter (O.D.), while a longitudinal bore 160 extending from the top end 152 to the bottom end 154 defines an inner diameter (I.D.). A recess 162 in the top end 152 is sized to receive a similarly-sized projection 164 at the bottom end 154 of another section 150 stacked linearly with the first section. The recesses 162 and projections 164 may be keyed or otherwise shaped to mate so that the helical flutes 156 and grooves 158 maintain continuity between sections.

FIGS. 13A and 13B are assembled and exploded elevational views of an exemplary process cooling rod formed with three of the modular flow diverter sections 150 as seen in FIG. 12A. The three sections 150 are stacked such that their recesses 162 and projections 164 mate, and the sections may be secured together by adhesive, sonic welding, or other such bonding technique. The stack of three sections 150 are placed within a tubular outer housing or jacket 170 with a length of Lx3 closed off by a closed distal cap 172, preferably hemispherical with a radius R. The radius R of the distal cap 172 is about the same as that of the jacket 170. A wall thickness t of the jacket 170 made of Stainless Steel is about 0.488 mm. The wall thickness t of the jacket 170 when made of Stainless Steel is preferably between about 0.4-0.5 mm.

The structure and function of the cooling rod thus formed is as described above with respect to the other embodiments herein. In particular, the helical ribs or flutes 156 have flat outer lands sized approximately the same as the inner diameter of the jacket 170, and the helical grooves 158 define helical flow passages within the jacket. The aligned longitudinal bores 160 extend the length of the cooling rod between the top end 152 and a plenum chamber 174 defined within the hemispherical cap 172. Pressurized fluid flowing into the through aligned bores 160 travels downward until it reaches the plenum chamber 174. The aligned helical grooves 158 of the sections 150 are open to the bottom end of the lowest section and thus the pressurized fluid within the plenum chamber 174 is forced upward along the helical passages within the jacket 170 defined by the grooves 158. Eventually, fluid reaches the top of the stacked sections 150 and may be removed via a connected manifold. As will be understood, the cooling rod may be adapted to be secured to various process vessels using diverse mounting arrangements such as seen in FIGS. 4-10.

The modular flow diverter sections 150 may be made in various sizes to enable combinations for different process applications. In general, the longer the sections 150 and the more sections in each stack, the greater the heating or cooling capacity. Likewise, larger diameter sections 150 with increased heating or cooling flow enable heating or cooling of larger volumes, or faster heating or cooling per se. Those of skill in the art will understand there are numerous such combinations.

One exemplary arrangement is flow diverter sections 150 having a length L of about 4 inches, an O.D. of about 0.93 inches, and an I.D. of about 0.25 inches. The axial dimension of the recesses 162 and projections 164 may be about 0.10 inches, with a radial dimension of around 0.40 inches. The depth of the grooves 158 in the exemplary embodiment may be 0.06 inches, with a width of about 0.10 inches. Again, there may be a single helical rib or flute 156, or two or more parallel flutes as shown. The radius R of the distal cap 172 as well as the jacket 170 may be about 0.5 inches, for a jacket diameter of about 1.0 inches. With the wall thickness of 0.4-0.5 mm, this creates a close fit between the O.D. of the flow diverter sections 150 and an inner wall surface of the jacket 170.

With reference back to FIG. 13A, and using the exemplary dimensions above, a cooling rod having a stack of three modular flow diverter sections 150 has a total stack length L of about 12 inches. A cooling rod of this size may be suitable for mounting within a process vessel of 10 liters, which has a depth that accommodates a vertical cooling rod down to a location near the floor of the vessel. A smaller 5 liter vessel may only need a cooling rod with two of the flow diverter sections 150 for a stack length L of about 8 inches. Similarly, a 20 liter vessel may be fitted with a cooling rod with four of the flow diverter sections 150 for a stack length L of about 16 inches. Larger vessels such as one with a volume of 50 liters require more sections 150, such as five or more, or wider sections with greater heat transfer capacity. Of course, the shape of the vessel into which the cooling rod is placed makes a difference, and shorter, squatter vessels will only accommodate shorter cooling rods, or cooling rods oriented other than vertically.

Figure 14A:
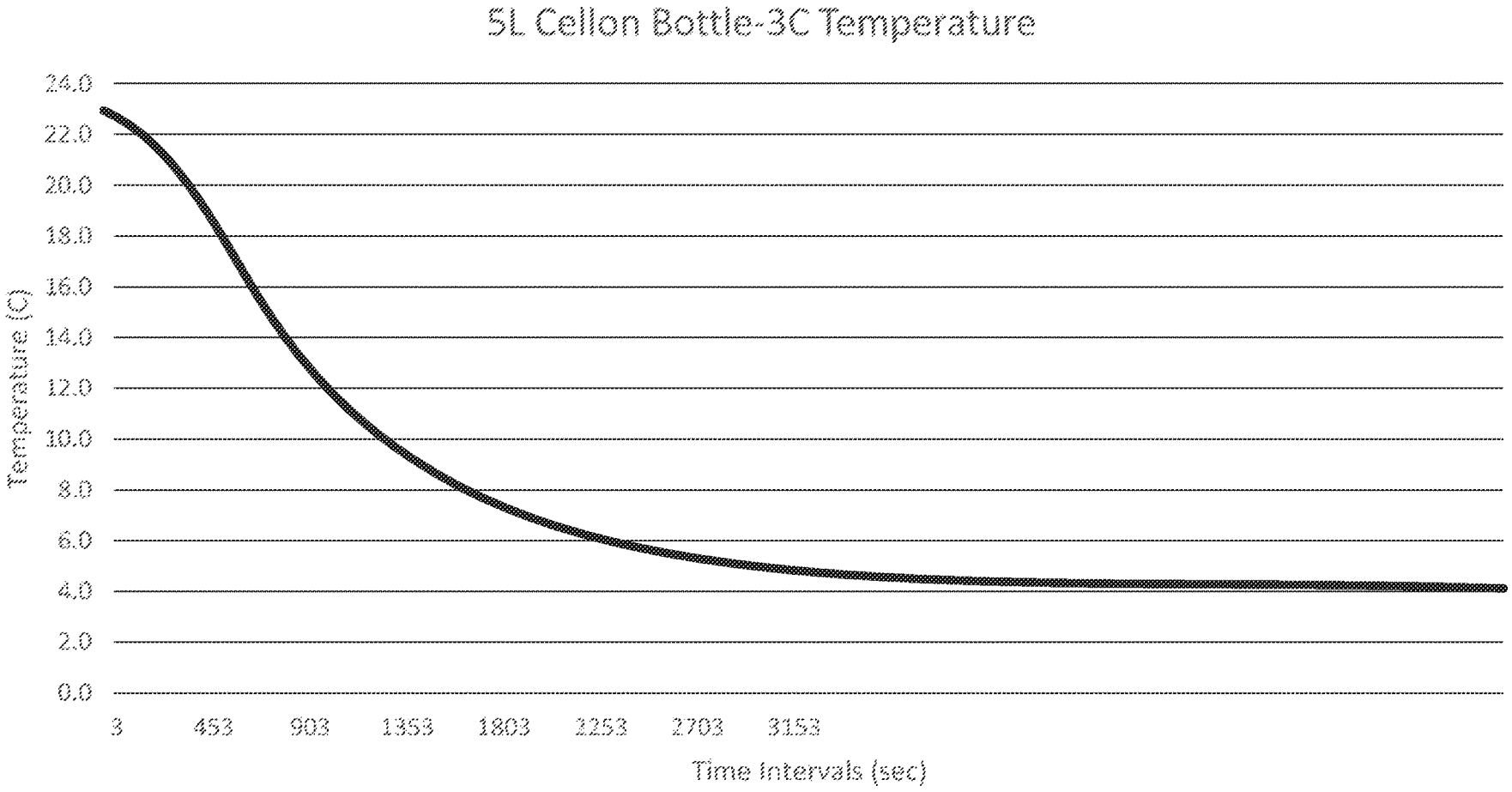
FIGS. 14A-14C are graphs showing test performance results when using the cooling rod of the present application in three different sized vessels.
Figure 14B:
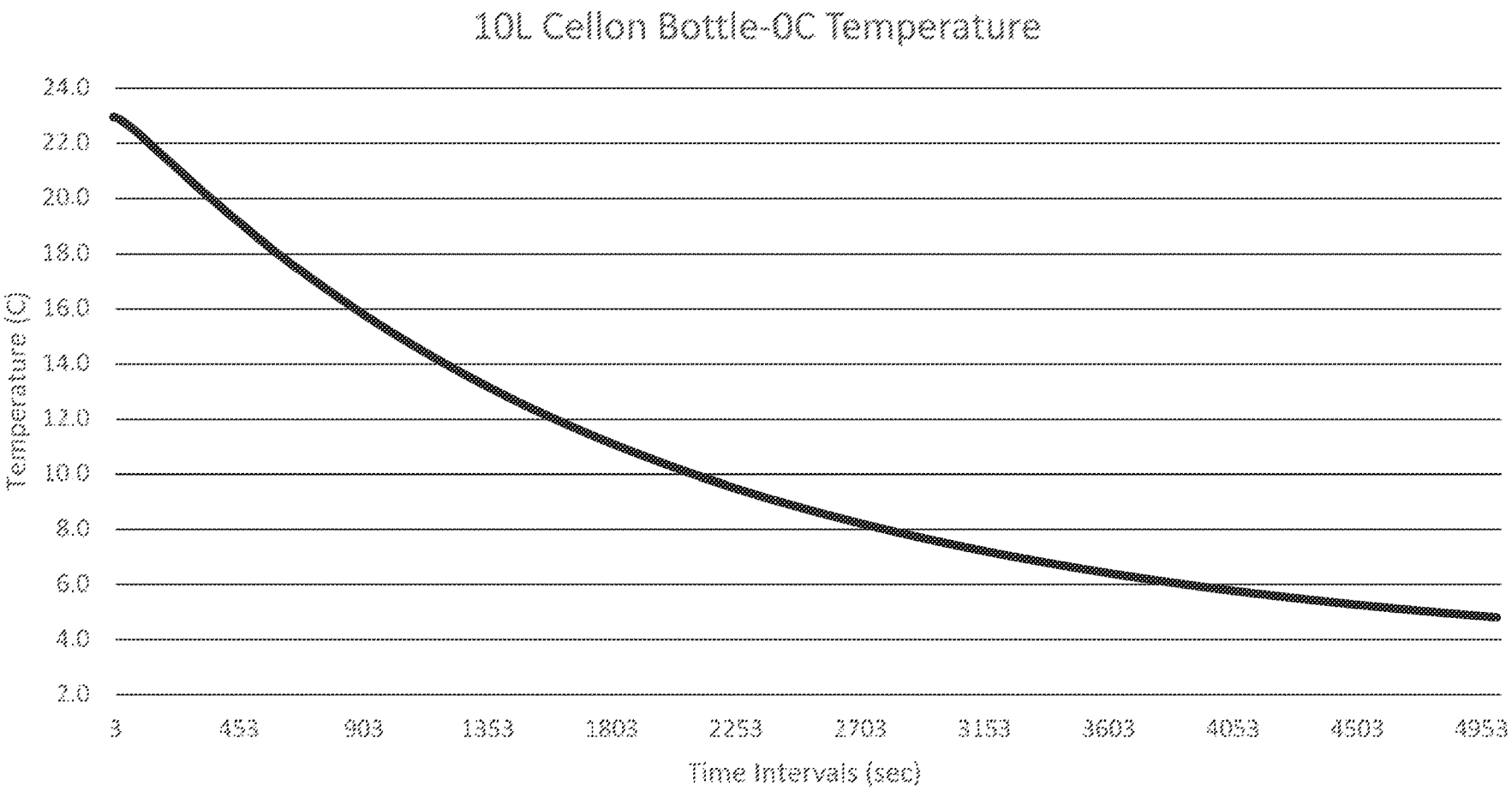
Figure 14C:
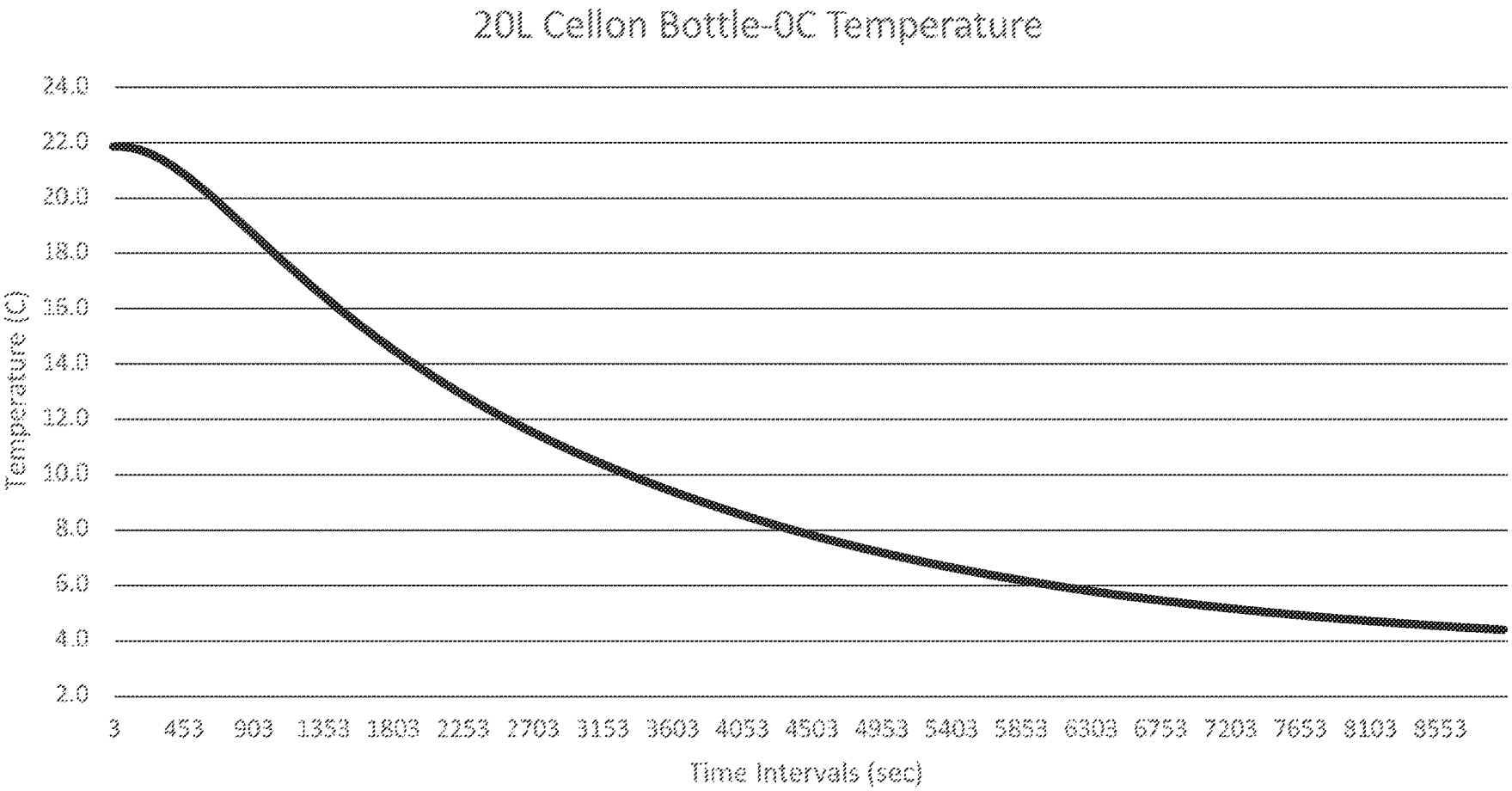

FIGS. 14A-14C are graphs showing test performance results when using the cooling rod of the present application in three different sized vessels. In each test, a volume of water was cooled from ambient down to a target temperature of between 4-8° C. using a flow of cooling fluid in a cooling rod described herein. The fluid used is Ethylene Glycol, which has a larger temperature change as compared to other cooling fluids that can be used such as Polypropylene Glycol. The cooling fluid was introduced at a temperature of either 0° C. or 3° C. as indicated in the graph titles. The flow rate was can range from 16-31 L/min, and each test whose results are shown was run at 31 L/min.

The tests were run within a 5-, 10- and 20-liter single-use products for use in the vaccine and bio-processing sector. So-called carboys and similar bottles are designed specifically for the storage and transport of bulk vaccines, biopharmaceuticals, bulk intermediates and other biotech materials.

FIG. 14A shows a test run within a 5 liter bottle. The test setup is similar to that shown in FIG. 11, with the cooling rod extending downward to a location near the floor 129, and a mixer 130 utilized to create movement within the fluid being cooled. The mixer 130 was run at 600 rpm, and an end target temperature was 4-8° C. Temperature samples were taken at 3 s intervals. As seen by the graph, a temperature of about 5° C. was reached in about 3153 sec., or about 53 minutes. This compares extremely favorably with prior methods of cooling such as surrounding the vessel with a heating or cooling blanket or placing the vessel within a cooler, which might take hours. It should be noted that a rapid cooling down to about half of ambient temperature occurred within 1000 sec., or about 17 minutes.

FIG. 14B shows a test run within a 10 liter bottle. Again, the test setup includes a vertical cooling rod extending downward to a location near the floor 129, and a mixer 130 within the fluid being cooled. The mixer 130 was run at 600 rpm, and an end target temperature was 4-8° C. Temperature samples were taken at 3 s intervals. As seen by the graph, a temperature of about 5° C. was reached in about 4953 sec., or about 83 minutes. This is much shorter than prior methods of cooling. Initially, a rapid cooling down to about half of ambient temperature occurred within 1803 sec., or about 30 minutes.

Finally, FIG. 14C shows a test run within a 20 liter bottle. Once again, the test setup includes a vertical cooling rod extending downward to a location near the floor 129, and a mixer 130 within the fluid being cooled. The mixer 130 was run at 600 rpm, and an end target temperature was 4-8° C. Temperature samples were taken at 3 s intervals. As seen by the graph, a temperature of about 5° C. was reached in about 7653 sec., or about 128 minutes. The fluid experienced a rapid cooling down to about half of ambient temperature within 2703 sec., or about 45 minutes.

Terms such as top, bottom, left and right are used herein, though the fluid manifolds may be used in various positions such as upside down. Thus, some descriptive terms are used in relative terms and not absolute terms.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It is claimed:

1. A system comprising a fluid process heat exchange rod for heating or cooling fluid in a process vessel, comprising:

an elongated outer jacket extending along an axis defining a closed distal end and an open proximal end, an inner cavity defined within the outer jacket;

a manifold attached to the proximal end of the outer jacket, the manifold having two connectors providing fluid communication with the inner cavity, a first connector being offset from a centerline through the manifold and a second connector being located along the centerline and aligned with the outer jacket axis;

an elongated polymer flow diverter positioned within the inner cavity, the flow diverter extending from the manifold to a point spaced from the closed distal end such that a distal space is formed in the inner cavity between the flow diverter and the closed distal end, the flow diverter having a central inner bore extending the length of the flow diverter and being in fluid communication with the second connector to fluidly connect the second connector and the distal space, the flow diverter also having an outer surface defined by two parallel helical flutes that extending the length of the flow diverter and having an outer diameter approximately equal to an inner diameter of the outer jacket so as to be in contact therewith, the helical flutes defining two parallel helical grooves spaced inward from the inner diameter of the outer jacket that forms two parallel flow passages between the flow diverter and the outer jacket fluidly connecting the first connector and the distal space; and a process vessel adapted for holding fluid, the process vessel having an upper wall, wherein the heat exchange rod is mounted to the upper wall of the process vessel such that the closed distal end of the outer jacket extends downward toward a bottom of a main portion of the process vessel so as to be submerged in fluid within the process vessel, wherein the outer jacket of the heat exchange rod has a length sufficient such that the closed distal end extends to within 1 inch of the lower floor of the vessel, wherein the heat exchange rod is configured such that fluid flowing into the second connector passes distally through the inner bore to the distal space, and returns proximally from the distal space through the at least one helical flow passage to the first connector, and fluid flowing into the first connector passes distally through the at least one helical flow passage to the distal space, and returns proximally from the distal space through the inner bore to the second connector, the fluid flowing through the heat exchange rod therefore being adapted to heat or cool fluid within the process vessel.

2. The system of claim 1, wherein the outer jacket is made of a non-reactive metal.

3. The system of claim 2, wherein the non-reactive metal is Stainless Steel.

4. The system of claim 2, wherein the polymer is polycarbonate.

5. The system of claim 1, wherein the elongated jacket is linear and tubular and the closed distal end is hemispherical.

6. The system of claim 1, wherein the process vessel is a flask having a large main portion and an upwardly angled shoulder region that forms the upper wall, and the heat exchange rod mounts through a hole formed in the upper wall.

7. The system of claim 6, wherein the heat exchange rod detachably mounts through the hole formed in the upper wall using a tri-clamp assembly or a threaded connection.

8. The system of claim 6, wherein the heat exchange rod is secured to the upper wall via adhesive or bonding/welding.

9. The system of claim 1, wherein the process vessel includes a mixer with vanes positioned just above a lower floor of the vessel and journaled to rotate about a vertical axis.

10. The system of claim 9, wherein the mixer incorporates magnets that face the lower floor to enable rotation by an external magnetic drive.

11. The system of system of claim 1, wherein the helical flutes flat outer lands that define the outer diameter of the flow diverter and contact an inner wall of the outer jacket.

12. A system comprising a fluid process heat exchange rod for heating or cooling fluid in a process vessel, comprising:

an elongated outer jacket extending along an axis defining a closed distal end and an open proximal end, an inner cavity defined within the outer jacket;

a manifold attached to the proximal end of the outer jacket, the manifold having two connectors providing fluid communication with the inner cavity, a first connector being offset from a centerline through the manifold and a second connector being located along the centerline and aligned with the outer jacket axis;

an elongated polymer flow diverter positioned within the inner cavity, the flow diverter extending from the manifold to a point spaced from the closed distal end such that a distal space is formed in the inner cavity between the flow diverter and the closed distal end, the flow diverter having a central inner bore extending the length of the flow diverter and being in fluid communication with the second connector to fluidly connect the second connector and the distal space, the flow diverter also having an outer surface defined by at least one helical flute extending the length of the flow diverter and having an outer diameter approximately equal to an inner diameter of the outer jacket so as to be in contact therewith, the at least one helical flute defining at least one helical groove spaced inward from the inner diameter of the outer jacket that forms at least one helical flow passage between the flow diverter and the outer jacket fluidly connecting the first connector and the distal space, wherein the flow diverter is formed of at least two identical modular sections stacked linearly and attached together; and a process vessel adapted for holding fluid, the process vessel having an upper wall, wherein the heat exchange rod is mounted to the upper wall of the process vessel such that the closed distal end of the outer jacket extends downward toward a bottom of a main portion of the process vessel so as to be submerged in fluid within the process vessel, wherein the outer jacket of the heat exchange rod has a length sufficient such that the closed distal end is in close proximity with a lower floor of the vessel, wherein the heat exchange rod is configured such that fluid flowing into the second connector passes distally through the inner bore to the distal space, and returns proximally from the distal space through the at least one helical flow passage to the first connector, and fluid flowing into the first connector passes distally through the at least one helical flow passage to the distal space, and returns proximally from the distal space through the inner bore to the second connector, the fluid flowing through the heat exchange rod therefore being adapted to heat or cool fluid within the process vessel.

13. The system of claim 12, wherein the outer jacket is made of Stainless Steel.

14. The system of claim 13, wherein the polymer is polycarbonate.

15. The system of claim 12, wherein the process vessel is a flask having a large main portion and an upwardly angled shoulder region that forms the upper wall, and the heat exchange rod mounts through a hole formed in the upper wall.

16. The system of claim 15, wherein the heat exchange rod detachably mounts through the hole formed in the upper wall using a tri-clamp assembly or a threaded connection.

17. The system of claim 15, wherein the heat exchange rod is secured to the upper wall via adhesive or bonding/welding.

18. The system of claim 12, wherein the outer jacket of the heat exchange rod has a length sufficient to extend to within 1 inch of the lower floor of the vessel.

19. The system of claim 12, wherein the modular sections are 4 inches long.

20. The system of claim 12, wherein the process vessel includes a mixer with vanes positioned just above a lower floor of the vessel and journaled to rotate about a vertical axis.

21. The system of claim 20, wherein the mixer incorporates magnets that face the lower floor to enable rotation by an external magnetic drive.

* * * * *